United States Patent [19]

Harding

[11] 4,110,195

[45] Aug. 29, 1978

[54] APPARATUS AND PROCESS FOR EXTRACTING OIL OR BITUMEN FROM TAR SANDS

[75] Inventor: Dukecal Jenner Harding, Jackson Point, Canada

[73] Assignee: Magna International Inc., Downsview, Canada

[21] Appl. No.: 802,099

[22] Filed: May 31, 1977

Related U.S. Application Data

[63] Continuation-in-part of Ser. No. 542,985, Jan. 22, 1975, abandoned.

[30] Foreign Application Priority Data

Jan. 24, 1974 [GB] United Kingdom ..... 3395/74
Mar. 11, 1974 [CA] Canada ..... 194555

[51] Int. Cl.[2] ..... C10G 1/04

[52] U.S. Cl. ..... 208/11 LE; 196/14.52; 210/513; 210/521

[58] Field of Search ..... 208/11 LE; 196/14.52; 210/513, 521

[56] References Cited

U.S. PATENT DOCUMENTS

| | | | |
|---|---|---|---|
| 2,474,006 | 6/1949 | Maycock | 196/14.52 |
| 3,256,986 | 6/1966 | Woosnam | 209/144 |
| 3,351,195 | 11/1967 | Hukki | 209/211 |
| 3,560,371 | 2/1971 | Kaminsky | 208/11 LE |
| 3,893,907 | 7/1975 | Canevari | 208/11 LE |

FOREIGN PATENT DOCUMENTS

| | | | |
|---|---|---|---|
| 883,974 | 10/1971 | Canada | 208/11 LE |

*Primary Examiner*—Herbert Levine
*Attorney, Agent, or Firm*—Beveridge, DeGrandi, Kline & Lunsford

[57] ABSTRACT

This invention relates to an apparatus and process for extracting bitumen from mineral particles such as sand. The invention avoids many of the problems of the conventional hot water or solvent extraction processes by using an abrading process to remove the bitumen or oil from sand particles, using cool water and little solvent. The abrading process involves agitating a pulp of tar sand and water, preferably with some small amount of diluent, and then moving this around an annular space at a speed low enough to allow settling of clean sand to form a sand bed in contact with the moving pulp, the speed being high enough to prevent settling of bitumen coated sand particles, so that the bitumen is abraded from the sand particles and rises in the pulp. Fines and clay which are removed with the water and bitumen can be separated from the water, after removal of the bitumen, to give a sludge suitable for mixing with the clean sand prior to disposal.

42 Claims, 5 Drawing Figures

APPARATUS AND PROCESS FOR EXTRACTING OIL OR BITUMEN FROM TAR SANDS

Figure 5:
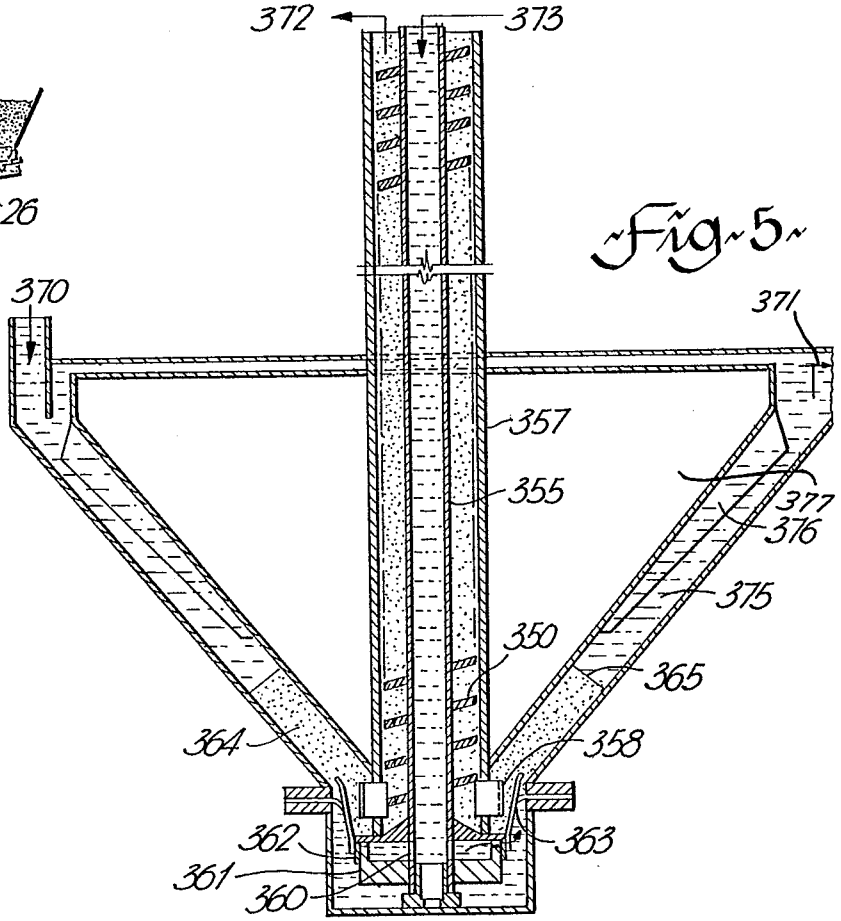

This application is a continuation-in-part of my copending U.S. Patent Application No. 542,985 filed Jan. 22, 1975 and now abandoned.

This invention relates to an apparatus and process for extracting oil or bitumen from mineral particles such as sand.

There are contained in a number of countries in the world, such as Canada, large deposits of tar sands which are located at or near the surface and are therefore susceptible to open pit mining for the recovery of bitumen from the sand, providing an economical method can be developed for separating the bitumen from the sand. The term "tar sand" as used herein will be understood to include bitumen containing sand, which is also sometimes referred to as "oil sand".

In the northern section of the Province of Alberta, Canada, there is located an extraordinarily large deposit of tar sand of which a substantial portion is located at or near the surface and it is therefore susceptible to open pit mining. The bitumen is often present in a ratio of appoximately 15 parts of bitumen to 85 parts of sand by weight. There is also a small amount of water, clay, silt, and light viscosity oil present. Accordingly, any process which is to be devised for separating the bitumen from the sand must be concerned with the handling of vast quantities of sand in order to recover a sufficient volume of bitumen to be commercially viable. The process must also avoid polluting large quantities of water with clay which can be difficult to separate from the water.

In the following specification, "sand" means siliceous material which is generally in a size range of 38 to 500 microns and mostly larger than 45 microns; smaller sand particles (i.e. silt), and clay particles being collectively referred to as "fines".

In connection with one of the existing methods for extracting bitumen from sand deposits in Northern Alberta, after the overburden soil is removed from the tar sand deposit, the tar sands are removed from their in situ location by means of giant bucket wheel excavators or drag lines which deposit the tar and sand mixture onto conveyor belts. These belts transport it to a central processing plant which can be several miles away, and this distance of course increases continuously as the source of raw material becomes further removed from the central processing plant. In existing installations the tar sand mixture is processed at the central plant where the bitumen is removed from the sand by means of a hot water extraction process. The extracted bitumen is then further processed to remove clay particles, trace metals and the like and is then processed by conventional refinery techniques into synthetic crude oil which is capable of being transported by pipeline to a central oil refinery for further processing.

The conventional method of processing the tar sands involves large amounts of energy to raise the temperature level of the tar sand and water mixture to a processing temperature of approximately 190° F. This is particularly a problem during the winter months in northern Alberta when the ambient outside temperature sometimes falls to −60° F. In the hot water process the large amount of heat required to raise the temperature of the water makes it uneconomical to use the ideal amounts of water which results in less than optimum quantities of bitumen or tar being recovered from the sand.

The presently used process also involves enviromental problems in disposing of the waste products. Desirably, the sand and clay which are the waste products should be returned to their original location, but this would involve transporting a sand and water slurry several miles, which would be uneconomical even if this were the only problem. The presence of clay in the mixture compounds the waste disposal problem, even if only small amounts of the clay are present. This is because the clay includes a component, montmorillonite, which, in the alkali water used in the process, in effect swells up and forms a thixotropic gel. The water used in the process, containing the clay and sand, is dumped into large reservoirs, which may be more than 2 square miles in area. Although these reservoirs are referred to as "settling ponds", in fact little settling of the clay occurs in any reasonable space of time, which means that little water can be re-cycled. The remainder stays in the reservoir, mixed with the clay gel; eventually the use of this process will result in a series of polluted lakes across the countryside. It will be understood that this water, due to the content of alkali and clay, cannot be merely returned to the river from which it came.

Another known process for recovery of the tar sand oil is the so-called "cold water" process, wherein a much lower (room) temperature water is used with solvents which will dilute the bitumen so as to cause its separation from the sand. This process uses less energy, but requires large amounts of solvents and is therefore expensive. Again, problems exist in disposing of the waste water which has substantial solvents and which contains suspended clay.

Many patents have issued concerning variations of these extraction methods; one prior patent which gives an extensive review of the art is U.S. Pat. No. 3,605,975 to Brimhall.

The present invention provides a process which can be operated with "cold" water (i.e. water which only needs heating in winter months); which can be operated with addition of little or no solvents; and which can be operated with neutral pH water so that the clay in the tar sands does not form a gel and can be removed, to a large extent, in a settling tank.

Both the hot and cold water process, in effect, cause a softening or disolving of the bitumen to cause this to be released from the sand particles. I have found that it is possible to cause the bitumen to be substantially entirely separated from the sand particles (excepting fines) by a mechanism which is wholly or very largely mechanical, and which can operate successfully in the absence of any alkali, and in the absence of heating above that required to bring the water, in which a slurry of the tar sands is formed, up to normal room temperatures. The substantially entire separation produced in accordance with this invention allows virtually clean sand to be separated from a first phase product which contains bitumen and fines, this product being then subject to further processing. The process of my invention is essentially an abrading and controlled separation process wherein a slurry of the tar sands mixed with a small amount of water is firstly produced by a milling process which breaks away bitumen from the sand, the slurry then being subjected to an agitation or shearing action which causes further separation of bitumen from sand, and then being moved horizontally at a controlled speed over a static clean bed of sand which is sand which has settled from the pulp after releasing its bitumen. The process includes a water dilution stage which precedes the last stage. The unique manner in which the diluted slurry or pulp is caused to flow over the sand bed ensures that any bitumen coated particles which reach the sand bed are rolled and abraded along the sand bed in such a way as to release the bitumen and to allow this to float to the top of the water. The process is self-regulating in the sense that the movement imparted to the pulp is sufficient to maintain any bitumen coated sand particles (and of course any bitumen lumps) in movement over the sand bed, the speed of the pulp being however sufficiently slow that bitumen free sand particles (other than fines) can settle on the bed. Accordingly, the sand bed only receives clean particles.

At the temperatures at which my process is normally operated, bitumen is slightly heavier than water, and in order for this to be removed from the zone of separation either an up flow of water must be maintained in this zone, or a small amount of diluent must be added to the tar sand sufficient to reduce the effective specific gravity of the bitumen below that of water. The latter procedure is preferred. However, the amount of diluent added, taken together with a small amount of surfactant which is also added to the water, are very small in comparsion to the amount of diluent used in the conventional cold water process. For example, amounts of diluent (kerosene) between 10% and 100% of the bitumen content of the tar sand may be suitable for my process (depending on the clay content of the tar sand); by contrast, previous cold water processes have used up to about 6 times as much kerosene as bitumen content. Also, no alkali is required, such as tends to cause clay to remain in suspension in the water. Since the water is not being heated, and since no significant amount of chemicals are being injected into the water, an amount of water giving the best separating conditions can be used without greatly detracting from the economics of the process.

In accordance therefore with one aspect of my invention, a method for the separation of bitumen from tar sand comprises the steps of:

mixing the tar sands with water to make a slurry, agitating and diluting this slurry with additional water to form a pulp having a water content at least equal to the tar sand weight and having a temperature in the range of about 35° to 120° F, Moving the pulp primarily horizontally within a separating zone at a controlled speed which is low enough to allow gravity settling of bitumen free sand particles (except fines) within said zone to form a substantially static sand bed in contact with the horizontally moving pulp, the speed being high enough, having regard to any upwards flow of back wash water, to prevent permanent settling of bitumen coated sand particles, withdrawing sand from the bottom of the separating zone at a rate suitable for maintaining the bed of sand within the zone so that bitumen coated sand particles can be freed from bitumen by tumbling along the upper surface of the bed, removing water and bitumen from an upper portion of the separating zone, and separating a bitumen froth from the water.

The water, after the removal of bitumen, contains fines, i.e. fine sand and clay particles, although since the water is non-alkali the clay does not form a gel and it is possible to remove the clay and fine sand from the water and return this water to the separating zone. Also, the fines are preferably mixed with the sand. In one arrangement, the fines containing water is recycled to the bottom of the sand bed and pumped up through the sand bed so that the sand filters out the fines which are eventually disposed of with the sand. This procedure gives an upwards flow of water in the separating zone and helps to float the bitumen particles to the top of the zone.

However, this procedure has some drawbacks, and I now prefer to pass the fines containing water to a settling tank from which substantially fines free water can be withdrawn for use in forming the initial diluted slurry of tar sands, and from which a sludge containing the fines, with some water, can be removed and mixed with the clean sand. For this purpose, the sludge can be injected into the sand bed so that the fines are filtered from the water by the bed. However, the introduction of the clay particles into the sand at this stage may cause some problems in removing the sand by a conveyor, and for this reason I may prefer to mix the sludge with the sand outside of the sand bed while this is being conveyed to a disposal point.

The separating zone is preferably a vertically elongated annular space, the pulp being moved around such space and the sand bed forming an annulus in the bottom of the space. Moving the pulp around an annulus in this way insures that all particles are properly treated in the separating zone no matter how low their settling rate may be. The pulp is caused to flow around the space at a speed low enough to allow settling of bitumen free sand particles at the bottom of the space, and also low enough that centrifugal forces do not determine the settling pattern of the sand. The annular space has a radial width which is less, and preferably considerably less, than its inner radius, being preferably less than ½ the inner radius, and in a preferred arrangement about ⅓, the inner radius of the annular space. This ensures that the velocity of the pulp around the annular space is substantially constant, i.e. varies by less than say 25% (in the preferred embodiment about 20%), from the inner to the outer wall of the annular space.

The speed of the pulp flowing in the separating zone is preferably between 100 and 200 f.p.m., and where this is an annular space the rotational speed is less than 50 r.p.m. to avoid significant centrifugal forces. A preferred speed for the pulp close to the sand bed (i.e. say 1 inch above the sand bed) is preferably of the order of 125 f.p.m., and at least between 100 and 140 f.p.m. The pulp is caused to flow around the annular space by vanes which are spaced above the sand bed, the velocity of the vanes being higher than the velocity of the pulp close to the sand bed, but this velocity still being less than 200 f.p.m. and preferably less than 140 f.p.m. A generally lamina flow is achieved around the annular space, although of course with some eddies being formed close to the sand bed and close to the inner and outer walls of the annulus.

The reference above to the speed of flow, and the fact that the velocity is insufficient to allow centrifugal force to determine the settling pattern of the sand, should indicate that the process which I use is quite different from known centrifugal separation processes. So far as I am aware, centrifugal separation has not been used for initial separation of sand and bitumen from tar sands, although centrifugal separation has been used to reduce the mineral and water content of a diluted oil froth which is the product of an initial separation process. For example, as described in U.S. Pat. No.

3,893,907 to Canevari, a conventional hot water type of process is used to separate a large portion of sand from a tar sand and water mixture, and a froth of water, non separated solids, and oil is then diluted and heated and passed into first a low speed centrifuge, and then a high speed centrifuge.

Basic differences between my process and that of Canevari, or like processes, should be evident from the above. Thus, my separation process is concerned with separating a slurry of tar sands and water which is passed directly from the agitating step into the annular separation zone, without previous processing as suggested by Canevari. Perhaps more important however is the basic difference between the relatively slow speed operation of my separation zone, and a centrifugal separation. A centrifugal separation would cause heavier particles such as sand to be flung outwardly towards the wall of a vessel, and if such a vessel were to be such as to allow a sand bed to settle therein then such sand will settle preferentially near the outside wall of the vessel. In my process, by contrast, the sand settles preferentially near the inner wall of the annulus since the speed of movement of the sand is less at the inside wall than at the outside, and the rotational speed is so slow that centrifugal forces do not counteract this tendency.

Further concerning prior art, I am aware of Canadian Pat. No. 883,974 to Cymbalisty, which shows a separator for use in the hot water tar sands separation process. This contains rotating blades which agitate the tar sand slurry and cause separation in a manner which may be similar to that of my agitation step. However, the sand bed which forms in this separator is not in contact with any horizontally flowing stream of water carrying the comminuted slurry, but is separated from the agitation zone by a series of baffles which would prevent any horizontal flow over the sand bed. Based on my experiments with vertical separation of water, sand and bitumen, the use of this separator, in the cold water conditions of my process, would not result in clean sand since lumps of slurry and bitumen coated sand particles would be entrained by the falling sand and would in effect settle on the sand bed.

The horizontal movement provided in my separation zone inhibits such entrainment by ensuring that sand and bitumen particles only meet in a glancing manner, and the horizontal movement, also inhibits bitumen particles from becoming adhered to sand particles.

I am also aware of the separator construction used by Great Canadian Oil Sands Limited, for example as shown in Canadian Pat. No. 882,667, in which a circular sand bed in the bottom of the hot water separator is slowly stirred by a rake. This may cause some removal of bitumen coated sand particles which have settled on the sand bed, although its primary purpose is to feed the sand to the central sand outlet. However, this general disturbance of the sand bed is not an efficient way of removing settled bitumen coated particles. The speed of movement of the sand rake is kept very low since otherwise power requirements would be high. Also, the sand rake cannot cause the fluid above the sand bed to move at a suitable controlled speed all around the sand bed and at the radially inner portions thereof.

My invention also comprises apparatus principally intended for the separation of bitumen from tar sands but which may have other applications in separating a product from a sand product mixture, as for example in the separation of potash from sand and clay particles. The apparatus, comprises:

a vessel having a top inlet for receiving a fluid pulp of sand/product mixture and water, a top outlet for water and product, and a bottom outlet for sand, said vessel having an inner and outer wall defining therebetween a annular space, said space including a sand settling zone having a radial width considerably less than the inner radius thereof, and lying below said top inlet and outlet and above said bottom outlet and communicating with all of said inlets and outlets and being such that sand can flow by gravity from said settling zone through said bottom outlet, a rotor carrying vanes movable around said annular space above said settling zone for causing movement of the pulp around said annular space without substantial disturbance of sand settled in said zone, and means (preferably conveyor means) capable of removing settled sand at a controlled speed from the bottom outlet at such a rate that a sand surface can be maintained within the settling zone of the annular space.

Again, such apparatus is clearly distinguished from centrifugal type separators, particularly since such separators rely on centrifugal forces for removing the sand from the vessel, rather than allowing the sand to form a sand bed therein and being provided with conveyor means for removing this sand.

The apparatus also preferably includes agitating means for agitating the products, sand and water mixture before this passes into the upper end of the annular space, and the agitating means may include co-operating vanes operating in an upper annular space which communicates at its lower end with the vertically elongated annular space, the co-operating vanes including vanes carried by the rotor.

A feature of apparatus in accordance with the invention is that this is relatively compact compared to presently used apparatus for tar sand separation, and I contemplate that a portable form of such apparatus may be built. In this case, the separating process may be operated near the sand digging face, avoiding problems with transporting the tar sand over a long distance to the separating plant, and transporting the clean sand back to the digging face.

Figure 1:
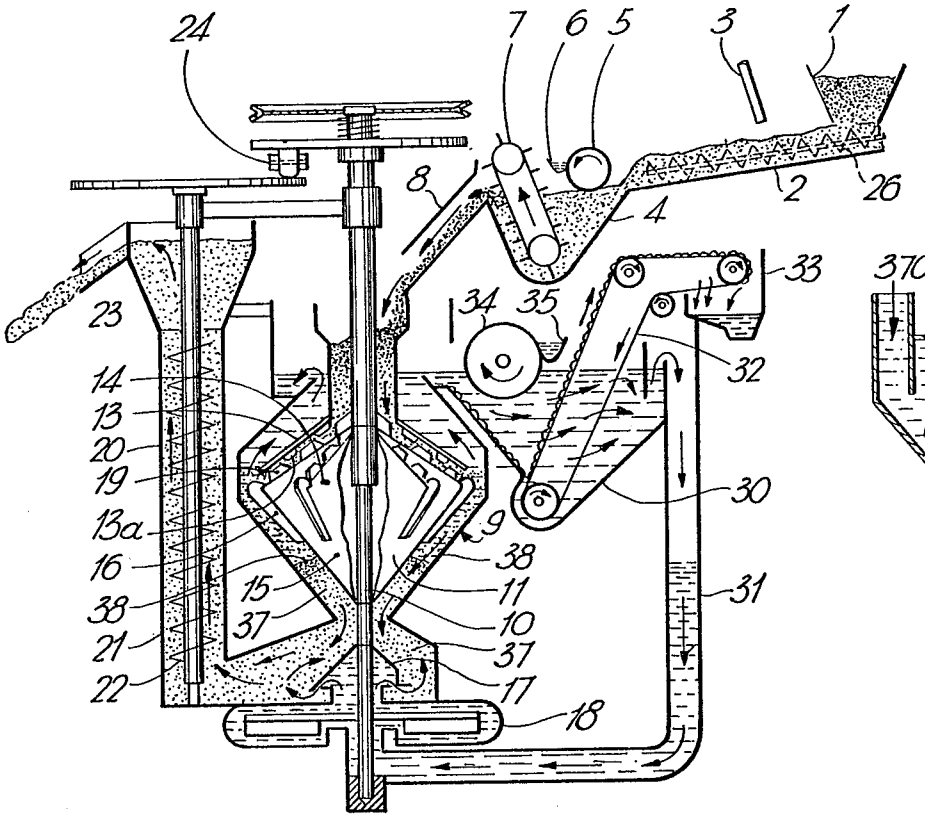
Figure 2:
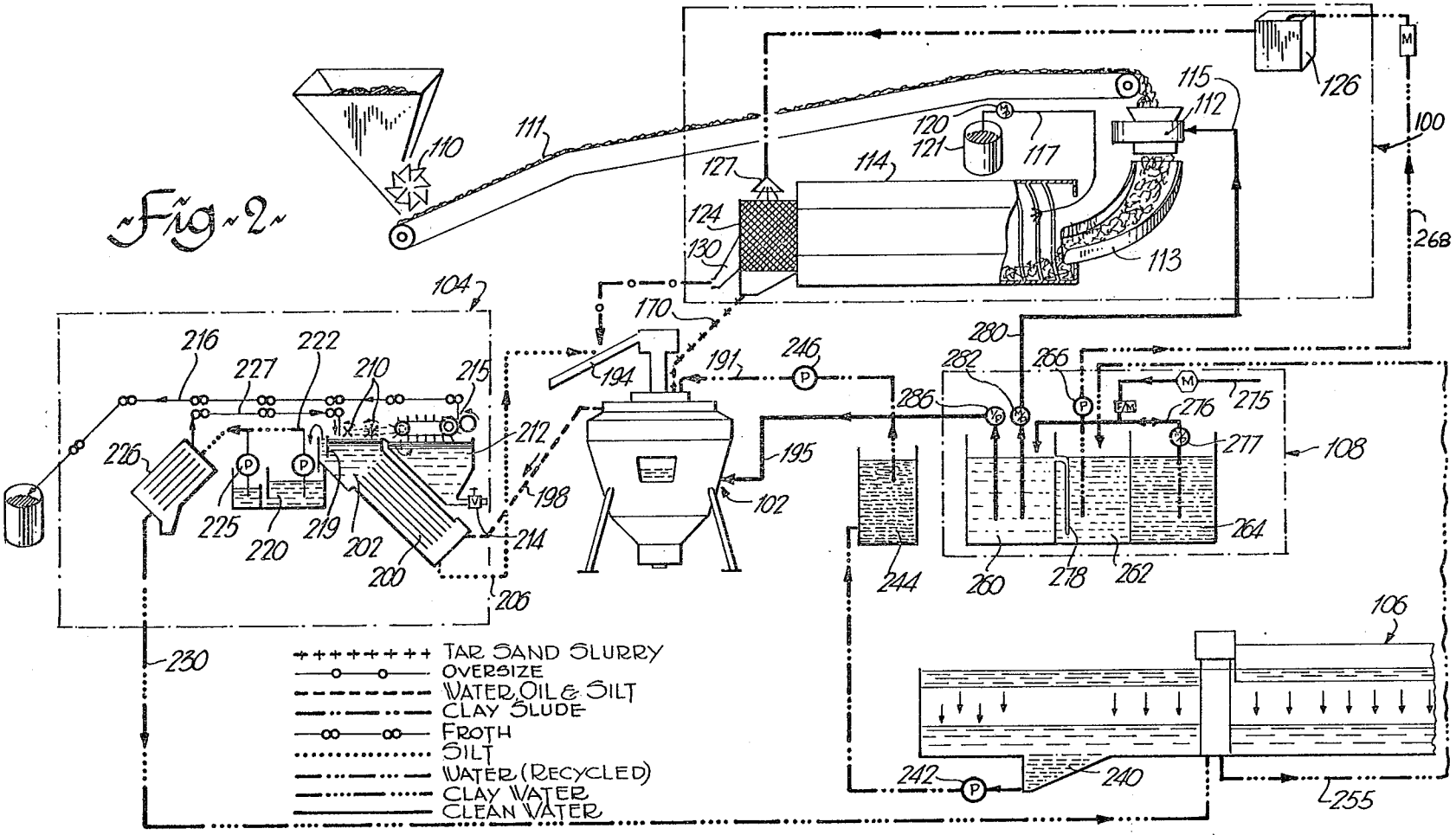
Figure 3:
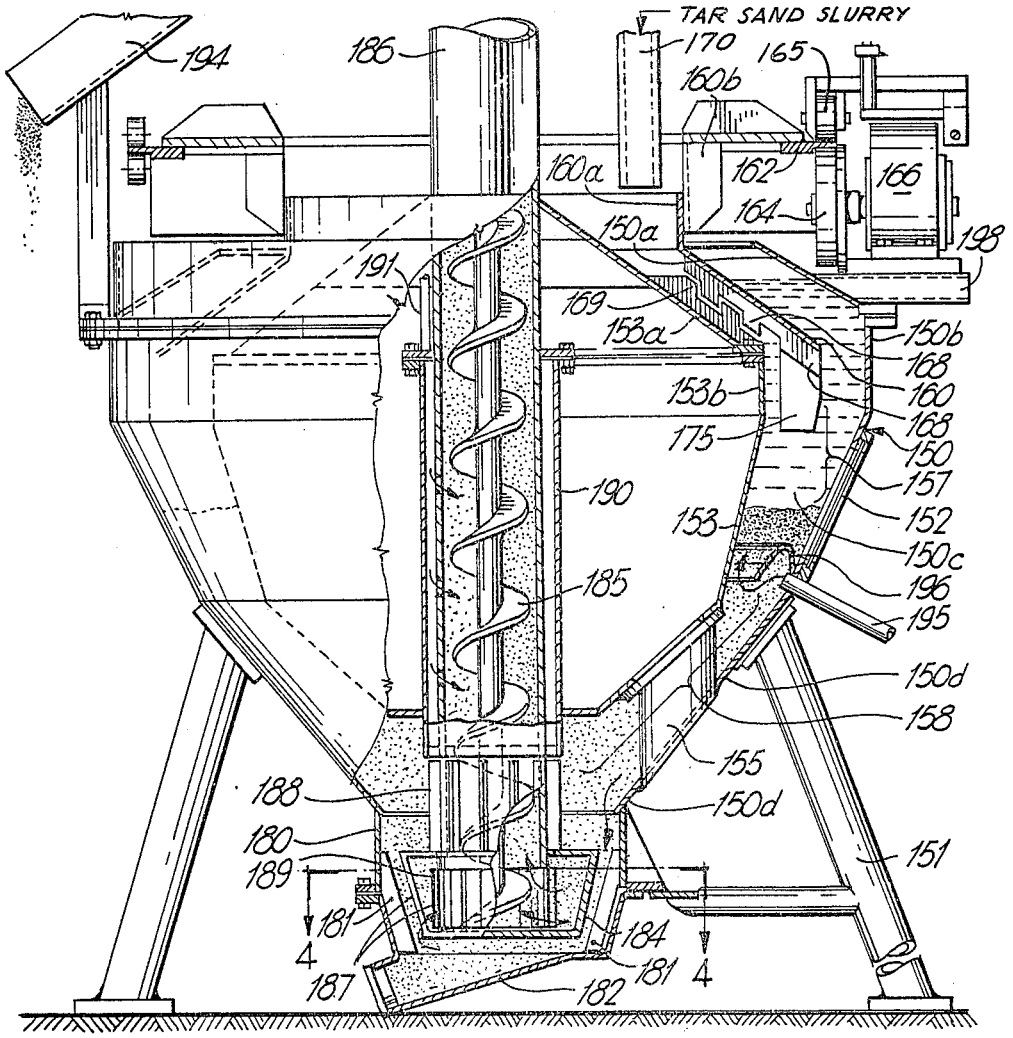
Figure 4:
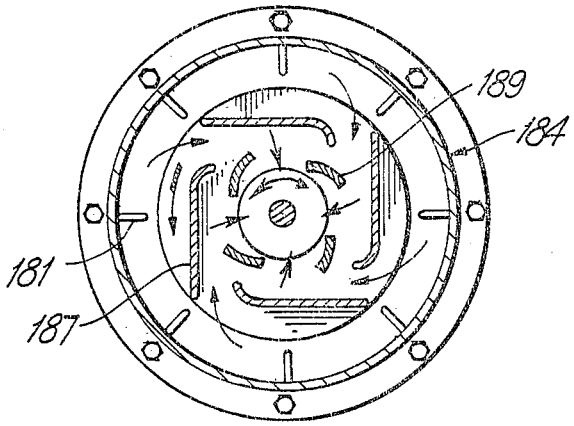

Other features and advantages of this invention will appear from the following descrption of the attached drawings wherein:

FIG. 1 is a sectional elevation of an extraction apparatus embodying one form of the invention, FIG. 2 is a schematic view of a modified and larger plant embodying the invention, FIG. 3 is a partly-sectioned elevation view of a separator used in the FIG. 2 plant, FIG. 4 is a view on lines 4—4 of FIG. 3, showing part of sand conveying means, and FIG. 5 is a diagrammatic view of a modified form of separator.

With specific reference first to FIG. 1 of the drawings, the apparatus consists generally of a receptacle 1 for receiving the tar sand mixture from the excavator, a mechanical mixer 2 having rotating paddles 26 which functions to break up the lumps of tar sand to a more homogeneous mixture, a source of water 3 which is fed into the tar sand mixture and is mechanically mixed with tar sand to form a slurry; a hopper 4 into which the tar sand-water slurry is deposited and a revolving wheel 5 which removes from the top of the slurry any deposits of oil which may have risen to the surface of the slurry in the trough 4.A trough 6 is disposed against the outside surface of the wheel 5 to remove any of the oil which as been deposited on the outside surface of the rotating wheel. A finned conveyor belt 7 serves to remove the tar sand mixture from the bottom of the hopper 4 so as to permit it to slide under gravity along a chute 8 into the top of the separator 9.

This separator 9 is composed of a power shaft 10 on which is fixed a rotor 11 which has conically shaped upper and lower portions 14 and 15 which converge respectively upwards and downwards from a common central plane where both portions have the same diameter, to the upper and lower ends of the rotor where the diameters are the same as that of shaft 10. The separator 9 includes an outer casing 12 which serves to contain the tar sand slurry within the casing and also to guide the movement of the various materials and water in a manner hereinafter described. The lower part of casing 12 is generally parallel to the outer surface of the lower portion of the rotor and forms therewith a vertically elongated, downwardly converging annular space having a radial width considerably less than its inner radius.

Contained within the outer casing 12 is an inner casing 13 which encircles a portion of the shaft 10 as well as the upper portion 14 of the rotor, forming therewith a downwards diverging annular space. This inner casing 13 serves to guide the slurry downwardly onto the outer surface of the upper rotor portion 14 and to guide the bitumen-water mixture as it leaves the separator as hereinafter described.

Attached to the outer surface of the upper portion 14 of the rotor 11 is a series of vanes 19 which co-operate with stationary vanes **13*a* an inner casing 13 to agitate and break up lumps of the slurry as it moves downwardly along the outside surface of the rotor this process forming a substantially homogeneous pulp. Attached to the lower inclined surface 15 of the rotor 11 is a second series of vanes 16 which extend vertically down the upper part (about half way) of surface 15 and which cause the slurry to move in a rotational direction around the annular space between surface 15 and the casing 12**.

Attached to the central shaft 10 below the bottom edge of the rotor 11 is a further inner casing 17 which functions to direct a downflowing sand-water mixture away from the base of the shaft 10 and to prevent the sand from entering the exit end of a water pump 18.

Attached to the lower end of the casing 12 adjacent to the left side of the casing is a sand auger mechanism 20 which is comprised of an outer casing 21 and a powered spiral auger 22. At the top side edge of the auger casing 21 there is an exit chute 23 which serves to carry cleaned sand out and away from the auger casing 21. The auger 22 may be powered through a variable speed drive 24 by means of the power source for the separator 11 (not shown) which may be a conventional electric motor attached by means of a drive mechanism to the separator shaft 10.

Adjacent to the right hand side of the separator 9 is a trough 30 which is attached at its one side to the top of the outer casing 12 and at its other side to a water return conduit 31.

Disposed within the trough is an endless conveyor 32 which functions to carry agglomerated particles of bitumen out of the trough 30 to be collected in collecting trough 33, while permitting water, fine particles of sand and clay to remain in trough 30. Also disposed within the trough 30 is a rotating oil collector wheel 34 which serves to skim any oil floating on the surface of the water mixture contained in trough 30 and to deposit it in a collecting trough 35 where it can be carried away to a holding or collecting tank (not shown).

The apparatus of FIG. 1 operates in the following manner. The tar sand mixture is received from the excavators and is deposited in the infeed receptacle 1. The mixture may have a temperature of approximately 40°-60° F so that except in winter, no heat input is necessary. If waste heat is available however, this can be used and will increase the efficiency of the operation. During winter operations, it may be necessary to enclose the gear mechanism which delivers the tar sand mixture from the excavator to the separator apparatus. The tar sand mixture which will contain a small amount of moisture is mechanically mixed by the rotating paddles 26 of the mixer 2 until the lumps of sand and tar have been broken down. Water is introduced to the mixture through the conduit 3 at a rate of approximately 30 lbs. water for each 100 pounds of tar sand mixture. Because of the different specific gravities of water and tar sand, this should result in a mixture of tar sand and water having a 1:1 ratio by volume. If the temperature of the tar sand mixture is not too far below 40° F. then the water need not be heated but can be drawn directly from a local source such as a river or lake. As the water and tar sand mixture proceeds through the mechanical mixer 2, the action of the paddles 26 forms a slurry. Because of the sloping bottom wall on the mixer 2 the slurry moves in the direction of the trough 4 where it flows into the trough and the heavier particulate material settles to the bottom. The tar sand mixture normally contains small amounts of free oil and this oil will float to the surface of the slurry where it is moved by a rotating drum 5 and carried away from the trough 6 to be stored in an appropriate receptacle. The lighter portion of the slurry flows out of trough 4 through conduit 8 into the top of the separator 9. The heavier parts of the slurry including the sand and tar particles are drawn out of the bottom of the trough 4 by means of the endless conveyor 7 and these heavier parts also travel down through the conduit 8 into the top of separator 9. The slurry collects within the upper walls of the inner casing 13, flows downwardly onto the top surface 14 of the separator rotor 11 where, through the action of gravity, the slurry flows outwardly towards the inside surface of the outer casing 12. The rotation of the vanes **13*a* with rotor 11 close to the stationary vanes 19 causes agitation of the slurry and any remaining lumps of tar sand are broken up so that a homogeneous slurry passes into the lower part of the separator surrounding surface 15**, where it mixes with upwardly flowing wash water to form a pulp. The agitation process also separates a large part of the bitumen from the sand particles, so that this contains clean sand particles and bitumen nodules along with some bitumen coated sand.

The sand particles tend to move downwardly against the slight movement of the wash water which is being pumped upwardly through the separator by the pump 18 as indicated by the flow lines in FIG. 1. At an operating temperature of 40°-60° F the bitumen tends to collect into nodules when separated from the sand particles within the separator. At the temperature range of 40°-60° F the bitumen has a specific gravity which is slightly heavier than water, generally in the range of about 1.002 to 1.02. It is not sufficiently heavy to move quickly downward with the sand particles against the slight upward flow of the wash water through the separator, with the result that the bitumen particles move upwardly with the flow of water and out of the separator and into the trough 30. As the flow of wash water upwardly through the separator is not sufficiently fast to carry away the sand particles, they settle downwardly through the wash water and deposit themselves in the lower part of the separator 9 between the outer casing 12 and the lower part 15 of the rotor 11. It has been observed in laboratory tests that the sand particles are held in suspension by the rotating vanes 16 of the separator rotor 11 until they arrive at a point just below the bottom edge of said vanes.

This point or level in the annulus formed between the inner rotor 11 and the casing 12 I call the critical zone and a bed 37 of cleaned sand forms in this zone, with a fairly discrete surface 38. It has unique properties due to the conical design and rotational speed of the vanes on the rotor 11. The separation of bitumen from sand particles occurs due to abrasion between the bitumen coated sand particles, which mostly occurs in the slurry forming and agitation stage, but also occurs close to the sand bed where particles are rolled along until they release their bitumen. The sand bed surface occurs at a point where the velocity of movement around the annulus is not sufficient to keep clean sand particles in suspension, the velocity of the movement of course decreasing from the lower ends of vanes 16, by reason of fluid friction on the sand bed and sidewall and by reason of the decreasing radius of the annular separation zone. Only substantially clean sand particles will settle in the critical settling zone since all other material present in the cell has a lower specific gravity and will therefore either be kept in fluid suspension or will roll along the surface 38 of the sand bed until substantially all of the lighter material is abraded from the sand surface. Then the resulting clean sand will immediately settle to the bottom of the settling zone (surface 38 of the sand plug 37).

The flow rate of water recycled into the bottom of separator should be slower than the rate at which the sand would be fluidized. The chief reason for the counter flow is to provide a cleansing action on the water for removal of some of the suspended solids, such as clay, by filtration through the sand. The speed of rotation of vanes on cone 11 and speed of water counter flow must be too low for clean sand to stay in suspension. At the critical interface point 38 the speed of rotation should be too high for bitumen to settle. A speed of about 125 f.p.m. has been found suitable; this speed, given the diameter of the separator does not cause any significant centrifugal separation of the sand.

The accumulated cleaned sand 37 at the bottom of the separator flows under gravity and by pressure from the incoming material downwardly towards the base of the auger mechanism 15 where it is carried upwardly and out of the auger mechanism through the discharge trough 23.

The bitumen nodules, which have some sand particles entrapped therein, are carried upwardly through the separator and out of the top of the separator into the trough 30, where the bitumen nodules, being, in the absence of solvent, heavier than the water, sink towards the bottom of the trough 30 where they come into contact with the surface of the conveyor belt 32. The conveyor belt 32 carries the bitumen nodules out of the trough 30 and into collecting trough 33 where they can be removed by any conventional means such as tanker trucks or when mixed with petroleum solvent, by pipeline to a central processing plant for secondary processing. Any free oil remaining in the water is removed from the surface of the water in the trough 30 by means of rotating drum 34 and the collecting trough 35. This oil as well as the oil collected in the trough 6 may be stored in suitable receptacles or may be mixed back in with the bitumen nodules in the trough 33.

Water flows out of the trough 30 and into the conduit 31 where it is returned to the inlet end of the pump 18 and is pumped under pressure through the sand 37 which has collected in the area adjacent the bottom of the rotor 11 and hence upwardly along the annular space between the rotor 11 and the outer casing 12. The sand particles which have collected in the lower portion of the separator act as a filtration bed to remove from the returning wash water a portion of the silt and clay particles which were carried upwardly with the bitumen nodules by the flow of the water through the separator. The fine clay and silt particles which are entrapped by the coarser sand particles are carried out of the separator by the auger mechanism 20. The amount of water recirculated is controlled, as by admission of make-up water, so that the total amount of water in the pulp being separated within the annular separation zone is between 1 and 3 times, and preferably 2 to 2½ times, the weight of tar sand.

It is important that the peripheral speed of the rotor 11 rotating the vanes 16 and 19 be correlated with the density and temperature of the slurry as well as the rate of flow upwardly of the wash water in order to ensure that the sand particles settle out of the slurry against the flow of the water while the bitumen nodules are carried upwardly and out of the separator. This can be controlled easily by visual observation of the level 38 through a window, or by other conventional means.

As the water level in the auger mechanism 20 will always be below the opening into the chute 23, the cleaned sand which is removed from the auger mechanism by the chute 23 will have with it only that portion of the water which is entrapped on the sand particles, as well as clay returned thereto by the recirculating water.

If apparatus in accordance with the invention is made portable, this will permit the removal of most or all sand from the bitumen at the mine site by a cold washing process. This would make it possible to dispense with the need for the extremely expensive conveyor belt for carrying the sand to a distant treatment plant. At its best this system may provide a pumpable oily liquid which may be sent by pipeline to the treatment plant. In the alternative, this invention may be used in a concentration step for removal of 60 to 90 percent of the sand at the mine site, with the remaining sand being present in a pumpable sand — oil — water mixture. The pipelines may be buried under the clean sand behind the mobile mind site extraction apparatus.

Only a supply of cold water is needed at the mine site, if the method is used as a concentration method.

If the method is used for total removal of sand at the mine site then some solvent will also be used. Any convenient solvent may be employed. The higher flash point materials are safer to use, but they generally exhibit lower solvency. Low flash point material such as naphtha may be used. This is very efficient, and leaves very little residue in the cleaned sand. However, it involves a high fire hazard and evaporation losses. Kerosene or gas oil may also be used. In particular kerosene involves a relatively low fire hazard, and very low evaporation loss. It is not quite as good a solvent for bitumen but it is found to be acceptable. More heat is required to drive it off from the bitumen for recovery and recycling. With the process described, using substantial flow of back wash water 10 to 20 percent of solvent based on bitumen content will desirably be added, as the small amount of solvent greatly lowers the viscosity of the bitumen, and renders it more easily separable from the sand and later from the water by reducing the density of bitumen and making it buoyant.

If a countercurrent back wash is provided it will remove some residual solvent from the sand.

EXAMPLE I

In apparatus similar to that of FIG. 1, 100 lbs. of tar sand material was mixed with 30 lbs of water, and mechanically mixed to produce the desired constituency of the slurry. The 100 lbs of raw material contained about 15 pounds of bitumen and 85 pounds of sand plus small amounts of water and clay. Seventy pounds of clean sand collected at the bottom of the separator together with approximately 25 pounds of water. A total of 35 pounds of material comprising 15 pounds of bitumen, 15 pounds of sand and 5 pounds of water and a small amount of oil was carried upwardly out of the separator and into the holding tank. In addition to the 5 pounds of water carried with the bitumen there was 125 pounds of water which is composed of 25 pounds of water remaining from the 130 pounds of slurry and 100 pounds of wash water which was passed up through the cleaned sand deposited in the bottom of the separator.

EXAMPLE II 31 lbs of Raw material (bitumen sand) was mixed for approximately 10 minutes with Naptha in the ratio of $$\frac{31 \times 16 \times 0.2}{100} = \text{(Naphtha) } 0.992$$

per 31 lbs raw material. Water was added in the proportion of $$\frac{31 \times 16 \times 0.4}{100} = 1.984$$

This resulted in a slurry of

| | | |
|---|---|---|
| raw material | = | 31.000 lb |
| Naphtha | = | 0.992 lb |
| Water | = | 1.984 lb |
| Total weight | | 33.976 lb |

This material was fed into a separator in accordance with the invention and operated for 15 min. Therefore, Extraction rate of machine tested = 31.0 × 4 = 124 lbs per hour. Therefore, assume bitumen content = 16% of dry weight, then the bitumen extraction rate was $$\frac{31 \times 16 \times 4}{100} = 19.84 \text{ lbs}$$

per hour or 476.6 lbs per day. The annular sand settling area of this machine used in this test had inner and outer diameters of 7 inches and 9 inches respectively.

Batch # 1-A Sample Run

ANALYSIS OF RESIDUE MATERIAL (BITUMEN) REMAINING IN TAILINGS (a) A sample of (tailings) was taken from the tailings of a 31 lb. run of raw material. A quantity of this material was dried over-night at 200° F

| | | |
|---|---|---|
| Weight of Flask | = | 98.1 g |
| Dry Tailings | = | 200.0 g |
| | | 298.1 g |

(b) The 200.0 g dry wt. sample was washed with naphtha in a total of 5 washes (the 5th wash being completely transparent & therefore considered clean). This sample was then thoroughly dried by evaporation at 300° F and re-weighed.

| | | | | |
|---|---|---|---|---|
| Total | = | 297.8 g Therefore, Material Weight | = | 200.0 g |
| Flask | = | 98.1 g Minus washed Material weight | = | 199.7 g |
| Dry Tailings | = | 199.7 g Equals soluble content | = | 0.3 g |

Known bitumen content of this sand batch in its' original (Pre-Processed State) was 16.4% Wgt. Therefore, original Bitumen content associated with 200 g of sand was:

$$\text{Original Total Weight}\left(\frac{200 \times 100}{83.6}\right) \times 16.4 = 39.234$$

Therefore, % of material not recovered from $$\text{Sand} = \left(\frac{0.3}{39.234}\right) \times 100 = .7646\%$$

Therefore, if loss is 0.7646% (in tailings) then recovery in water & solvent is - (100 - 0.7646) = 99.2345% Note:

This figure of 0.765% does not include any loss that may occur due to suspended bitumen in the clay-water filtration.

The above description relates to a laboratory scale apparatus. A larger apparatus has now been built, and is described with reference to FIGS. 2, 3 and 4. One major difference of the new apparatus is that, instead of water from the separator being recycled through the sand bed, the water passes to a settling tank from which relatively clean water is passed to the incoming slurry as this is being fed to the separator. A sludge of clay, and fine sand, with water, is withdrawn from the settling tank and mixed with the clean sand. Only a small amount of relatively clean back wash water is used, so that there is little upwards flow of water in the separator. This makes it necessary to use an amount of solvent sufficient to reduce the effective specific gravity of bitumen to less than 1 having regard to any solids content.

Referring to the layout of the new plant shown in FIG. 2, the main items are:

- a preliminary tar sands treatment apparatus indicated at 100,
- a separator vessel indicated at 102,
- apparatus for separating bitumen from water, indicated at 104,
- a settling tank for separating water from clay and fines, indicated at 106, and
- a recycled water treatment apparatus indicated at 108.

Tar sand, as mined, is passed through a star wheel feeding device 110 which breaks up any large agglomerates of the tar sand, and feeds this onto a belt conveyor 111. The sand falls from the belt conveyor into a chain flail device 112 which breaks up lumps of the tar sand, the tar sand then passing onto chute 113 which leads to entry end of a slurry forming feed mill 114. This mill rotates about a horizontal axis and has an internal helical flight so that it operates in manner similar to an Archimedes' screw. A pipe 115 leads to a spray device arranged to spray water onto the tar sand within the chain flail device 112, to give preliminary wetting of the clay therein. A further pipe 117, fed with diluent through a diluent metering pump 120 from tank 121, leads to a further spray device within the mill which sprays diluent on the tar sand sufficient, when absorbed by the bitumen, to reduce the effective density of the bitumen (at room temperature) to below that of water so that the bitumen is buoyant in the separation process. The tar sand slurry leaving the mill enters a rotating, selfcleaning screen 124, which is provided with a supply of wash water from tank 126 via spray device 127. The screen 124 removes lumps of clay, or stones, from the tar and slurry, these leaving through a chute 130. The removal of clay lumps at this stage is very useful since this clay does not have to be separated at a later stage from the water. A further screen (not shown) may be provided to remove over-size agglomerates of tar sand and return these to the inlet end of the mill.

The tar sands which have passed through the screen wash, and mixed with the water from device 127, enter the top of the separator 102 which is shown in detail in FIG. 3 of the drawings.

The separator vessel has an outer casing 150, of generally downwardly converging conical form, supported on legs 151. The casing however includes an upper portion 150*a* which diverges downwardly, a short cylindrical section 150*b* next below this, an upper downwardly converging section 150*c* having a window 152, and a lower section 150*d* which converges downwardly more sharply than section 150*c*. Within the vessel there is fixed inner casing 153, which also converges downwardly in two stages generally matching the converging sections of the outer casing. The lower part of the inner casing is rigidly connected to the outer casing by a series of circumferentially spaced supports 155, which are tubular in cross-section and are also elongated in the vertical direction so as not to unduly inhibit the flow of sand around them. The inner casing includes an upwardly converging upper section 153*a*, joined to the downwardly converging sections by cylindrical section 153*b*. The inner and outer casings thus define between them, beginning at the top of the vessel, a downwardly diverging annular space, a cylindrical annular space, a vertically elongated separation zone 157 which converges downwardly both in respect of its inner and outer radius and respect of its radial width, and below this a sand bed space 158 between the lower casing sections, the diameter of which diminishes downwardly, but the radial width of which increases in the downwards direction. The upper end of the separation space 157 has an outer diameter of about 45 inches and an inner diameter of about 33 inches so that in this annular space as a whole the radial width is about $\frac{1}{3}$ of the inner radius, and certainly less than $\frac{1}{2}$ of the inner radius.

In this embodiment, the rotor is not attached to the inner walls of the separator vessel, but is in the form of a frusto-conical plate 160 which extends between the upper portions of the inner casing 150*a* and 153*a*, being carried via a short cylindrical section 160*a* and connecting members 160*b*, by an annular plate 162. This annular plate has an outer flat portion which is gripped between rollers 164 and 165, the lower roller 164 being driven by a motor 166 to rotate the ring 162 and with it the rotor. The plate 160 carries a series of radial vanes 168, extending from the underside of plate 160 and having irregular lower edges which are complementary to and spaced about $\frac{1}{4}$ inches above the upper edges of radial vanes 169 fixed to inner casing portion 153*a*. The slurry is arranged to be fed in through tube 170 between the inner casing portion 153*a* and the rotor 160, so that the vanes 168 and 169 break up the slurry as this passes down the annular space between the rotor and the inner casing, and agitate the slurry so that it forms a pulp with the water.

The rotor 160 also carries a series of vanes 175 which are of vertically elongated form and which extend down into the top of the separation zone 157. These are arranged to cause a steady rotary movement of the tar sand and water pulp around the zone 157. The speed of the motor 166 can be varied to give the rotor speeds between 10 and 14 r.p.m. Taking 10 feet as the circumference of the top of zone 157, the vanes 175 can have speeds between 100 and 140 f.p.m; the preferred speed being around 125 to 130 f.p.m.

At the lower end of the outer casing is provided a generally cylindrical sump area 180 which holds the lower end of the sand bed. A series of fixed vanes 181 extend into this sump area, also shown in FIG. 4. Spaced from the inner edges of the vanes 181 is a sand scoop rotor 184, which is attached to the lower end of an auger 185. The auger 185 extends axially upwardly through the separator vessel, within a tube 186. A lower portion of the tube 186, which communicates with the annular space between the lower conical portions of the inner and outer casings, has a series of radial vanes 188. The sand scoop rotor 184 thus operates in a portion of the sand bed which is largely prevented from rotation by the vanes 181 and 188, so that the scoop members 187 of the rotor are effective to scoop the sand inwardly towards the bottom end of the auger. A bottom portion of tube 186 extends within rotor 184 and has openings defined by louvres 189 angled to assist the inwards movement of sand as the rotor rotates.

A central portion of the auger tube 186, starting close to the lower extremity of the inner vessel wall, is surrounded by an outer sludge tube 190, into the upper end of which sludge can be injected through pipe 191. Ports 193 are provided in the wall of the auger tube 186, to allow sludge to flow from the sludge tube into the auger tube to be carried upwardly with sand being transported by the auger. The upper end of the auger tube connects onto a sand disposal chute 194.

Around the base of the separation zone 157 there is provided a series of back wash water injection inlets. These include a series of small tubes 195 attached to a back wash water manifold, and a series of baffles 196 which provide a containment space above the ends of tubes 195 and ensure reasonably good dispersion of the back wash water into the sand without channeling.

The separator vessel has a bitumen and water outflow pipe 198, which extends through the outer upper wall 150*a* of the vessel, above the level of the vanes 175. As seen in FIG. 2, this bitumen and water outflow pipe leads to the lower end of a first plate separator 200, the bitumen and water mixture flowing up between the parallel plates of the separator to a reservoir portion 202, where the bitumen, freed from some of the fine sand, rises to the top of the water. The upwards flow disposition of the separator is primarily designed to allow some fine sand and silt to separate out from the water, and this is disposed of through the outlet tube 206 to the same disposal point as the sand.

The bitumen layer on the top of reservoir 202 is moved by elongated rotating paddle devices 210 into a second reservoir 212, where some further fine materials separate and is removed through a sump valve 214 to join line 206. The bitumen layer on the top of reservoir 212 is picked up by a mechanical scooping device 215 and passed to an outlet tube 216 for the diluted bitumen. The bitumen is then sent for further processing for example by centrifuging and fractional distillation.

Water flows out of reservoir 202 into a tank 220, barrier 219 preventing the surface bitumen from also flowing out. The splashing of water into tank 220 releases some more bitumen which floats to the top of this tank and is pumped into pipe 222. Water passes from the bottom of tank 220 into tank 224, from where it is pumped by pumps 225 and 225A into pipes 222, and 222A passing along from tank 220 into the top of a second plate separator 226. The bitumen within pipes 222 and 222A does not mix with the water but remains in the top of separator 226, where it mixes with further bitumen removed from the water by this separator which is orientated for bitumen separation. This bitumen leaves the top of the second plate separator and is returned via line 227 to the reservoir 202. Also, a small amount of fines can be removed from the bottom sump 229 of this second plate separator. The water leaving this separator however still contains a certain amount of fine sand and silt and considerable quantities of clay particles, and these pass via a line 230, firstly to the central column, and then to the rotating boom assembly, of the setting tank 106. This settling tank is circular in plan view, and the rotating, radial, boom assembly is designed to allow the water and clay suspension to enter the top of the settling tank, via the rotating boom, in a way which creates minimum disturbance of the surface of the settling tank. Simultaneously, the rotating boom is arranged to remove a top layer of the water lying in the settling tank, ahead of the insertion of the dirty water, so that the boom is continually scooping up relatively clean water at its front end and leaving the dirtier water at its rear end. This settling tank is the subject of my co-pending U.S. Patent Application No. 750,489, filed Dec. 14, 1976, and will therefore not be further described herein.

The fine sand and clay collects in the sump 240 of the settling tank, and is moved by a pump 242 to a sludge storage tank 244, from which it is periodically pumped by a further pump 246 into the sludge inlet pipe 191 of the separator, for mixing with the cleaned sand.

Relatively clean water picked up by the boom assembly of the settling tank is passed via line 255 to the recycled water treatment apparatus 108. This includes three containers, 260, 262 and 264, and the water from the settling tank is directed into the central container 262. This relatively clean water, but which contains small amounts of fines and clay, is recycled by pump 266 through pipe 268 back to the storage tank 126 which supplies the water for mixing with the incoming tar sand.

Since some water is continually leaving the system in the sand and sludge, and in the bitumen froth, there is a continual need for makeup water which is supplied through pipe 275, which leads through flow control devices into the left hand container 260 which contains clean makeup water. A branch pipe 276 is connected into pipe 275, and supplies, via a metering pump 277, small amounts of diluted surfactant from tank 264. A connection 278 between containers 260 and 262 allows some of the clean water, with the surfactant, to pass back into the recycled water. However, most of the clean water in tank 260, and having the surfactant, passes firstly via pipe 280 and metering pump 282 to the water spray which initially wets the incoming tar sand. A further amount of this clean water is passed by injection pump 286 and pipe 287 into the separator vessel via pipe 195, to provide the back wash water for the sand. It is found that using clean back wash water for the sand is desirable to avoid this becoming clogged by fines.

The apparatus as described above is capable of accepting about one metric ton per hour of input tar sand.

In operation, the sand as mined is fed via star wheel 110, which breaks up large agglomerates of the tar sand, and this then passes on conveyor 111 into chain flail 112 where the incoming tar sand is sprayed by water from pipe 115, the amount of water being just sufficient to wet all the clay in the feed. Without this prewetting, an undesirably large proportion of the diluent will be absorbed by even quite small amounts of clay mixed with the sand. The amount of water for a given tar sand composition can be found by taking a sample of the tar sand and soaking this in water for about 1 minute, and then lifting the tar sand from the water and determining the amount of water absorbed. The amount will vary greatly with the clay content of the tar sand, being generally between 5 and 60% of the tar sand weight. Where it is inconvenient to pre-test the tar sand in this way, the pre-wetting water can be added in several stages, within the mill, and the consistency of the slurry observed.

The wetted tar sand after passing into the mill 114, is sprayed with diluent, preferably kerosene, via the pipe 117. The amount of diluent can be varied quite widely, since only a small amount is needed to give the desired reduction in density of the bitumen, but it can be helpful to use larger quantities in that the bitumen froth produced by the process contains less entrapped fines and water droplets when a fairly large amount of diluent is used. The diluent can be largely recovered in subsequent processing. Generally, an amount of diluent between 25% and 100% of diluent per unit weight of bitumen content of the tar sand is used.

The wetted tar sand with the diluent is tumbled in mill 114 for 20 minutes, to form a slurry in which the diluent is properly absorbed. This milling operation, performed with limited quantities of water and diluent, itself causes bitumen to break off the sand particles since the bitumen to bitumen adhesion is stronger than the bitumen to sand adhesion. The slurry then passes into the screen separator 124, where it is sprayed with water from spray device 127. The chain flail 112 and mill 114 are such as not to break up hard lumps of clay, so that these lumps can be disposed of along with stones, by the screen. Unbroken aggregates of tar sand can be removed by a separate screen and returned to the inlet end of the mill. The mixture of tar sand slurry and water then passes down pipe 170 into the separator. The amount of water used at this stage is usually such as to bring the total water content of the mixture up to between 2.5 and 3 times the weight of tar sand. This mixture passes, from pipe 170, into the diverging annular space within the separator between the inner casing part **153*a* and the rotor 160, where it is agitated and comminuted by the closely spaced relatively moving vanes 168** and 169. These vanes disperse the tar sand in the water as a pulp, and in addition cause an abrading action between the tar sand particles, and a rotational action, which further separates the bitumen from the tar sand before this passes into the annular separating zone 157.

On passing into zone 157 the pulp is moved around this zone in a steady manner by the vanes 175, and since this zone is free of internal projections the pulp here loses it turbulance and rotates as a body within the zone. The speed of movement is such that any particles with more than a minute amount of bitumen adhering thereto are kept in suspension, as are fines. The released bitumen and fines tend to flow upwardly within the outer annular space surrounded by the outer casing part **150*b*, and thence out of the water and bitumen outlet pipe 198. In the lower part of the separation zone a bed of sand forms which is almost entirely of clean sand. The sand bed surface can be observed through the window 152, and this allows the speed of the vanes 175** to be suitably adjusted to ensure that only clean sand settles on the bed, and so that not too great a quantity of sand particles is kept in suspension.

Sand is continually removed from the bottom of the bed by the combined operation of the rotor 184 and the auger 185, the scoops of the rotor acting against fixed vanes 181 to scoop the sand into the bottom of the auger which then carries the sand up through the tube 186 to the entry point into the disposal chute 194. Some drainage of the sand occurs since the top of shute 194 is above the water levle in the cell. However, there is a constant loss of water from the system in the sand which contains about 25% by weight of water. Sludge, i.e. fine sand and clay mixed with water, and which has previously passed out of the water outlet pipe 198, is recovered from the settling tank and is injected down the pipe 191 to pass through the ports 193 into the sand moving up the auger. In this way, the sludge can be removed well mixed with the sand, and does not pollute the environment to a major extent.

The liquid leaving the pipe 198 is about 90% water, about 5% bitumen and solvent mixture, and around 5% fines (clay and silt). Some of the bitumen is combined with the clay in a colloidal suspension. In the bitumen extraction apparatus 104, which includes the two plate separators and the tank 220, substantially all of the free bitumen and solvent mixture is removed as a bitumen froth which also contains some waters and some fines, and which is suitable for further processing by conventional means. The majority of the water, fines, and the colloidal suspensions pass into the settling tank, where the fines settle out for removal as a sludge, and reinjection into the sand as described. Fairly clean water is removed from the setting tank, and passed to the water treatment area 108, from where the water is recycled largely to the incoming slurry.

As indicated, for back washing of the sand bed, I now prefer to use substantially clean makeup water, with some surfactant, which is stored in the tank 260. This is injected via the pipe 195 into the sand bed in a pulsed manner to avoid channelling of the water through the sand bed. The primary purpose of the back wash water is to remove from the sand the few particles of bitumen which are entrained therein, and also to remove the finest particles which otherwise hinder drainage of water from the sand.

It will be appreciated that many changes may be made in this process within the scope of the invention.

Thus, while it is an economic advantage of the process that it can be used with room temperature, unheated water, there are advantages to using heated water if a suitable supply of cheap heat is available. Also, the proportions of the incoming mixture which can be used, as to proportions of water to tar sand, and diluent to tar sand, are widely variable, depending on economic circumstances. Thus, using plenty of diluent is desirable in producing a froth which does not trap much fines and water, but on the other hand an acceptable froth can be produced using only a small amount of diluent should this be better for the overall economics of the process. Also, it is quite possible to use an amount of water more than 3 times the total weight of tar sands.

FIG. 5 shows a further embodiment of separator, and illustrates that the step of separating bitumen particles from sand particles to give a clean sand bed can be performed separately from the agitating and comminuting step. The upper part of the separator is connected to any convenient very high turbulance pulp feed device, from which pulp enters through inlet 370. The pulp is rotated around annular space 375 by vanes 376 on rotor 377 which, as in the first embodiment, also forms the inner wall of the annular space.

Auger 350 is fixed to pipe 355 which may be stationary but is preferably rotatable in a direction opposite to the rotor direction to allow for variation of sand removal independent of rotor speed. The auger 350 rotates within rotor support casing 357 provided with wing scoops 358. Back wash water enters the pipe 355 through inlet 373 and leaves the pipe through ports 360, trickling between cup 361 and inverted fitted cap 362. It then passes upwardly past flexible seal 363 and upward into settling zone 364.

I claim:

1. A method for the separation of bitumen from tar sands comprising the steps of:

mixing the tar sands with water to make a slurry, agitating this slurry and diluting the slurry with water to form a pulp having a water content at least equal in weight to the weight of tar sand and having a temperature in the range of about 35° to 120° F., moving said pulp primarily horizontally around an annular separating zone at a controlled speed which is low enough to allow gravity settling of bitumen free sand particles within said zone to form a rotationally static sand bed in contact with said horizontally moving pulp, the speed being high enough, having regard to any flow of back wash water, to prevent permanent settling of bitumen coated sand particles, withdrawing sand from the bottom of said separating zone at a rate suitable for maintaining said bed of sand within said zone so that bitumen coated sand particles can be freed from bitumen by tumbling along the upper surface of said bed, removing water containing fines and bitumen from an upper portion of said separating zone, separating bitumen from the water, and separating fines from said water to provide substantially bitumen-and-fines-free-water said bitumen-and-fines-free-water being returned to said separating zone while said fines are mixed with the bitumen free sand.

2. A method according to claim 1, wherein said steps of returning water to the separating zone and mixing the fines with the bitumen free sand is performed by causing the fines containing water to flow upwardly through the sand bed into the separation zone so that fines are trapped in the sand.

3. A method according to claim 1, wherein said fines containing water is passed to a settling tank, from which substantially fines-free water is withdrawn for use in forming the diluted slurry of tar sands before the slurry is agitated, and from which tank a sludge containing the fines is removed and mixed with the bitumen free sand.

4. A method according to claim 3, wherein said sludge is injected into the sand bed so that the fines therein are filtered through said bed.

5. A method according to claim 3, wherein said sludge is mixed with the sand after its removal from the bed.

6. A method according to claim 1, wherein said tar sands contain clay, and wherein said process is performed in substantially non-alkali conditions.

7. A method according to claim 1, wherein an amount of diluent up to 100% by weight of the bitumen content of incoming tar sand is added to the incoming tar sands before the formation of said pulp, said diluent being suitable for lowering the effective density of bitumen and being substantially the only effective diluent or solvent added to the slurry or pulp.

8. A method according to claim 7, further comprising the step of wetting the tar sands with water before addition of the diluent.

9. A method for the separation of bitumen from tar sand comprising the steps of:

wetting the tar sands with between 5% and 60% by weight of water, and then mixing the wet tar sands with an amount of diluent suitable for lowering the effective density of the bitumen up to 100% by weight of the bitumen content, of the tar sands and milling the mixture to form a slurry, diluting the slurry with water to form a pulp having a water content at least equal in weight to the weight of tar sand and having a temperature in the range of about 35° to 120° F., moving said pulp primarily horizontally around an annular separating zone at a controlled speed which is low enough to allow gravity settling of bitumen free sand particles within said zone to form a rotationally static sand bed in contact with said horizontally moving pulp, the speed being high enough, having regard to any flow of back wash water, to prevent permanent settling of bitumen coated sand particles, withdrawing sand from the bottom of said separating zone at a rate suitable for maintaining said bed of sand within said zone so that bitumen coated sand particles can be freed from bitumen by tumbling along the upper surface of said bed, removing water containing fines and bitumen from an upper portion of said separating zone;

separating bitumen from the water, and separating fines from said water to provide substantially bitumen-and-fines-free-water said bitumen-and-fines-free-water being returned to said separating zone while said fines are mixed with the bitumen free sand.

10. A method according to claim 9, wherein said diluent is substantially the only effective diluent or solvent added to the slurry or pulp.

11. A method according to claim 1, wherein said annular separating zone is vertically elongated.

12. A method according to claim 11, wherein the speed of movement of said pulp within the separating zone is of the order of 125 f.p.m.

13. A method according to claim 1, wherein said pulp is caused to flow around said annular separating zone at a speed low enough to allow settling of bitumen free sand particles in a bottom portion of said zone and low enough that centrifugal forces do not determine the settling pattern of the sand.

14. A method according to claim 11, wherein said annular separating zone has a radial width considerably less than the radius of the inner boundary of said zone above said sand bed.

15. A method according to claim 11, wherein the velocity of the pulp within said annular zone is between 100 and 200 f.p.m. at a height one inch above the said sand surface.

16. A method according to claim 1 wherein said fluid pulp has a water content between 1 and 3 times the weight of tar sand.

17. A method according to claim 1, wherein the temperature of the fluid pulp is between 35° F and 75° F.

18. A method for the separation of bitumen from tar sands comprising the steps of:

mixing the tar sands with water to make a slurry, diluting this slurry with at least its own weight of additional water at a temperature in the range of 35° to 120° F., agitating the diluted slurry to separate the particles thereof, and to form a pulp and to cause partial separation of bitumen from sand, causing the pulp to pass directly into an annular separation space, causing the pulp to flow around said annular space at a speed which is low enough to allow settling of bitumen free sand particles at the base of said space to form a non-rotating sand bed in contact with the moving pulp, the speed being high enough having regard to upwards flow of back wash water to prevent permanent settling of bitumen coated sand particles, while being low enough that centrifugal forces do not substantially affect the settling pattern of the clean sand, withdrawing sand from the bottom of said annular space at a rate suitable for maintaining a bed of sand within said annular space, said bed of sand having an upper surface contacting the pulp flowing around said annular space, so that bitumen coated sand particles can be freed from bitumen by abrasion with the upper surface of said bed, and removing water and bitumen from an upper portion of said annular space, and separating the bitumen from the water.

19. A method according to claim 18, wherein said temperature of the slurry is less than 75° F.

20. A method according to claim 18, wherein back wash water is caused to flow upwardly through the sand in said bed.

21. A method according to claim 18, wherein, before adding the additional water to said slurry, an amount of diluent up to 100% by weight of the bitumen content of incoming tar sand is added to the slurry, said diluent being such as can be absorbed by bitumen to lower the effective specific gravity thereof to less than unity, said diluent being substantially the only effective diluent or solvent added to the slurry or pulp.

22. A method according to claim 18, wherein the radial width of said annular separation space is less than one half the radius of the inner boundary of said space above said sand bed.

23. A method according to claim 18, wherein the radial width of the annular separation space at a predetermined level thereof is about one third the radius of the inner boundary of said space at said predetermined level.

24. A method according to claim 18 wherein the circumferential velocity of the pulp flowing within said annular space at the mean radius thereof are close to the sand bed is between 100 and 140 f.p.m., and the rotational speed is less than 50 r.p.m.

25. A method according to claim 18, wherein the mean radius of said annular space decreases downwardly, whereby the velocity of the pulp also decreases in the downwards direction.

26. A method according to claim 24, wherein the velocity of the pulp at the top of the annular space is less than 140 f.p.m.

27. A method according to claim 18, wherein the agitation of the pulp is performed in an upper annular space which communicates at its lower end with said annular separation space.

28. A method according to claim 18, wherein the amount of water present in the pulp is between 1 and 3 times the weight of sand.

29. A method according to claim 18, wherein said annular space is vertically elongated.

30. Apparatus for the separation of bitumen from tar sands, comprising:

a vessel having a top inlet for receiving a slurry of tar sand and water, a top outlet for water and bitumen, and a bottom outlet for sand, said vessel having an inner and an outer wall defining therebetween an annular separation space, said space including a sand settling zone lying below said top inlet and outlet and above said bottom outlet and communicating with all of said inlet and outlets and such that sand can flow by gravity from said settling zone through said bottom outlet, a rotor carrying vanes movable around said annular space above said settling zone for causing movement of the pulp around said annular space said vanes terminating above said sand settling zone, means capable of removing settled sand at a controlled speed from said bottom outlet at such a rate that a sand surface can be maintained within said settling zone of the annular space, said means for removing sand being a conveyor means suitable for removing sand from said bottom outlet of the vessel and being arranged to carry the sand upwardly to a discharge point which is above the top inlet for pulp of the vessel, and means for removing bitumen from bitumen containing water leaving said top outlet.

31. Apparatus according to claim 30, wherein said conveyor means is an auger positioned centrally within said vessel.

32. Apparatus according to claim 31 wherein the sand outlet of the vessel includes an annular space surrounding a bottom extension of said auger, said latter space having fixed vanes to inhibit rotation of sand therein, and said auger extension having vanes rotatable with the auger to scoop sand into the lower end of the auger.

33. Apparatus for the separation of bitumen from tar sands, comprising:

a vessel having a top inlet for receiving a slurry of tar sand and water, a top outlet for water and bitumen, and a bottom outlet for sand, said vessel having an inner and an outer wall defining therebetween an annular separation space, said space including a sand settling zone lying below said top inlet and outlet and above said bottom outlet and communicating with all of said inlet and outlets and such that sand can flow by gravity from said settling zone through said bottom outlet, a rotor carrying vanes movable around said annular space above said settling zone for causing movement of the pulp around said annular space, said vanes terminating above said sand settling zone, means capable of removing settled sand at a controlled speed from said bottom outlet at such a rate that a sand surface can be maintained within said settling zone of the annular space, means for removing bitumen from bitumen containing water leaving said top outlet, and wherein means are provided for separating a fines containing sludge from water removed from the vessel, and means are provided for mixing the said sludge with said sand after the sand has settled in the sand bed.

34. Apparatus for the separation of bitumen from tar sands, comprising:

a vessel having a top inlet for receiving a pulp of tar sand and water, a top outlet for water and bitumen, and a bottom outlet for sand, said vessel having an inner and an outer wall defining therebetween an annular separation space lying below the top inlet and outlet and above the bottom outlet and communicating with all of said inlet and outlets, an upper part of said space constituting a separating zone and a lower part of said space constituting a sand settling zone in free communication with said upper part, the settling zone having an outer boundary formed by a fixed downwardly converging outer wall portion and being such that sand can flow by gravity from the settling zone through said bottom outlet, a rotor carrying vanes, said vanes being located in said annular separation space between said walls and being movable around said separating zone for causing movement of pulp around said zone, said vanes terminating above said sand settling zone so that in operation said pulp can be caused to move around said separation zone by said vanes while sand remains relatively static in said settling zone, means capable of removing sand in controlled manner from said bottom outlet at such a rate that a sand surface can be maintained within said settling zone, and means for removing bitumen from bitumen containing water leaving said top outlet.

35. Apparatus according to claim 34 wherein said annular space is of vertically elongated cross-section and has a radial width considerably less than the radius of the inner boundary of said lower part of said space.

36. Apparatus according to claim 34 wherein said annular space decreases in means diameter from its upper to its lower end.

37. Apparatus for the separation of bitumen from tar sands, comprising:

a vessel having a top inlet for receiving a slurry of tar sand and water, a top outlet for water and bitumen, and a bottom outlet for sand, sand vessel having an inner and an outer wall defining therebetween an annular separation space, said space including a sand settling zone lying below said top inlet and outlet and above said bottom outlet and communicating with all of said inlet and outlets and such that sand can flow by gravity from said settling zone through said bottom outlet, a rotor carrying vanes movable around said annular space above said settling zone for causing movement of the pulp around said annular space, said vanes terminating above said sand settling zone, agitating means for separating the bitumen coated sand particles from each other before said slurry passes into the upper end of said annular separation space, said agitating means being positioned in an upper annular space communicating at its lower end with said annular separation space, said upper annular space being defined between a fixed wall attached to the vessel and an upper portion of said rotor, said fixed wall and upper rotor portion having cooperating blades for separating particles of slurry passing therebetween, means capable of removing settled sand at a controlled speed from said bottom outlet at such a rate that a sand surface can be maintained within said settling zone of the annular space, and means for removing bitumen from bitumen containing water leaving said top outlet.

38. Apparatus according to claim 37 wherein said upper annular space increases in mean diameter from an upper end thereof to the lower end of said upper annular space, and wherein said annular separation space decreases in mean diameter from the lower end of said upper annular space to the lower end thereof.

39. Apparatus according to claim 34 wherein means are provided for supplying back wash water upwardly through said sand bed.

40. Apparatus according to claim 33 wherein said mixing means include an inlet for said sludge into said sand conveyor means.

41. Apparatus according to claim 34, wherein said means capable of removing sand from said bottom outlet is adjustable to remove the sand at rates independent of the speed of rotation of the rotor.

42. Apparatus according to claim 39, wherein said means for supplying back wash water includes water inlet aperture means disposed around said sand settling zone.

* * * * *